US006132352A

United States Patent [19]

Rider

[11] Patent Number: 6,132,352

[45] Date of Patent: Oct. 17, 2000

[54] DUAL MODE INVERTER AND AUTOMATIC VARIABLE FOLD POSITION SHEET FOLDING SYSTEM

[75] Inventor: Jason P. Rider, Penfield, N.Y.

[73] Assignee: Xerox Corporation, Stamford, Conn.

[21] Appl. No.: 09/197,850

[22] Filed: Nov. 23, 1998

[51] Int. Cl.[7] ..... B31F 1/00; B31F 7/00

[52] U.S. Cl. ..... 493/419; 493/420; 271/902; 271/288; 271/303

[58] Field of Search ..... 270/32, 45; 271/288, 271/303, 301, 902; 493/419, 420, 437, 444

[56] References Cited

U.S. PATENT DOCUMENTS

| | | | |
|---|---|---|---|
| 3,901,501 | 8/1975 | Kistner | 493/444 |
| 4,359,217 | 11/1982 | Roller et al. | 271/186 |
| 4,900,391 | 2/1990 | Mandel et al. | 156/364 |
| 5,076,556 | 12/1991 | Mandel | 270/45 |
| 5,085,625 | 2/1992 | Kojima | 493/444 |
| 5,131,649 | 7/1992 | Martin et al. | 271/302 |
| 5,183,246 | 2/1993 | Edwards et al. | 493/420 |
| 5,364,332 | 11/1994 | Gray, Jr. | 493/23 |
| 5,377,965 | 1/1995 | Mandel et al. | 270/37 |
| 5,540,647 | 7/1996 | Weiermann et al. | 493/444 |
| 5,655,765 | 8/1997 | Asami et al. | 271/902 |
| 5,720,478 | 2/1998 | Carter et al. | 271/902 |

OTHER PUBLICATIONS

"6/84" dated Xerox Corp. "1055" product "Technical Overview", description of a sheet "Folder/Inverter" on p. 12–10, 12–6, and 12–9.

*Primary Examiner*—Eugene L. Kim

[57] ABSTRACT

Selectable inverting or folding of various sizes of sheets in various fold positions is provided with an integral dual mode inverting or folding apparatus including a sheet inverting chute for receiving and guiding a sheet therein and having both an input and an intermediate aperture; and a reversible servo driven sheet drive in the chute downstream of the intermediate aperture. A sheet fed into the chute for inversion is reverse driven back to the chute input. A sheet fed into the chute for folding is instead stopped at the desired folding position by the servo drive and reverse driven out of the intermediate aperture into a sheet folding nip, preferably with the assistance of a blade member moved through the intermediate aperture to buckle and push that portion of the sheet adjacent to the intermediate aperture into the sheet folding nip.

5 Claims, 1 Drawing Sheet

DUAL MODE INVERTER AND AUTOMATIC VARIABLE FOLD POSITION SHEET FOLDING SYSTEM

Figure 1:
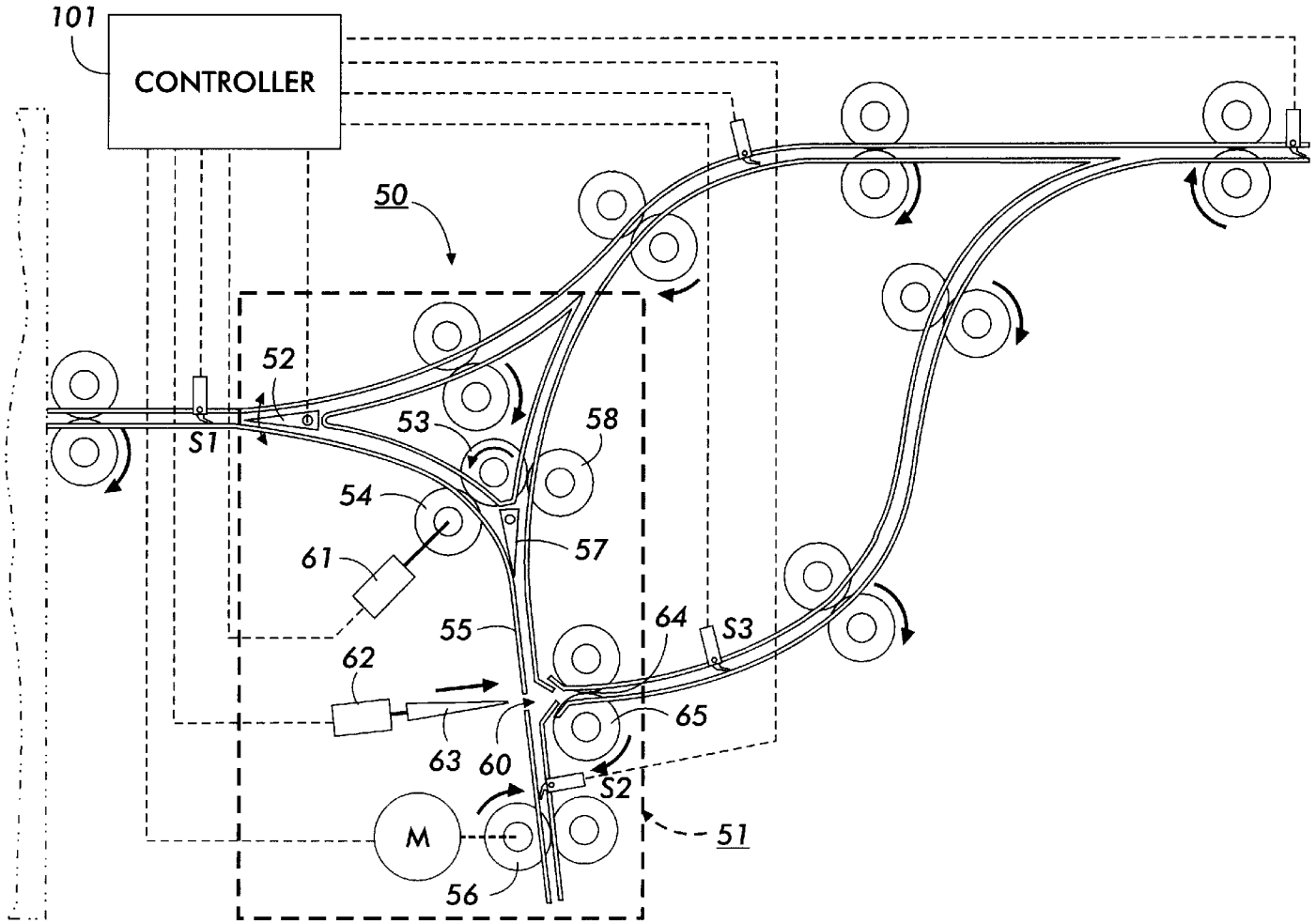

Cross-reference and incorporation by reference is made to a contemporaneously filed application of the same assignee, Docket No. D/98572, entitled "AUTOMATICALLY CONTINUOUSLY VARIABLE FOLD POSITION SHEET FOLDING SYSTEM WITH AUTOMATIC LENGTH AND SKEW CORRECTION", by Barry P. Mandel and Joseph J. Ferrara, App. Ser. No. 09/197,976.

Disclosed in the embodiments herein is an improved system for folding printed sheets, especially printed sheets outputted from a reproduction system, in a compact, dual mode, inverter/folder system which in a first mode can automatically provide folding of sheets at almost any desired fold position along the sheet without requiring resetting of mechanical sheet stop or registration members, and which in a second mode can provide inverting of different size sheets for inverted sheet stacking, duplex (two sided) copying, or the like. This dual mode integral inverter/folder system is particularly desirable for providing a sheet folding option product feature enhancement at low additional cost and no additional floor space for many copiers and printers already having an integral internal or modularly attached sheet output inverter.

Numerous types of sheet folding systems, including buckle-type sheet folding systems with folding rollers, with or without reciprocating blade or knife-edge folding assistance devices, are well known in the art. The following patent disclosures are noted merely as examples: Xerox Corp. U.S. Pat. No. 5,377,965 issued Jan. 3, 1995, Xerox Corp. U.S. Pat. No. 4,900,391 issued Feb. 3, 1990, and U.S. Pat. No. 5,076,556 issued Dec. 31, 1991, to the same Barry P. Mandel, et al, and other references cited therein. It is also well know to provide a sheet folding system with a manually slidable or otherwise repositionable mechanical fold stop, for changing the desired fold position on the sheet, or for accommodating different sheet sizes, which requires an operator to mechanically unbolt, move, and re-bolt the fold stop in its new position.

Of particular interest is Xerox Corp. U.S. Pat. No. 5,364,332 issued Nov. 15, 1994 to Gary A. Grey, Jr. (D/90012) on a sheet folder, disclosing for example in its "Abstract" that:

"Folding is accomplished by feeding a copy sheet into a stepper/servo controlled pinch roll that is under software control. The copy sheet is measured and the reversible roll nip is cycled from full forward to full reverse velocity with controlled acceleration. The reversing of the sheet causes a buckle to be created and the sheet creased by a secondary set of rolls." [Forming an upstream sheet-folding nip at one side of the paper path].

In another type of sheet handling system, sheet inverters, it is known to provide sheet inverters with reversible rolls in the inverter chute, such as for different sheet sizes, and to do so as part of an overall sheet output system with multiple sheet output paths, in which the inverter provides a path gating station, as shown for example in Xerox Corp. U.S. Pat. No. 5,131,649 issued July 21, 1992 to M. J. Martin, et al.

Of particular interest here is a "6/84" dated Xerox Corp. "1055" product "Technical Overview", description of a sheet "Folder/Inverter" on p. 12-10, 12-6, 12-7 and 12-9. However, it is specifically stated in this description that only 11×17 inch (A3 size) paper can be folded with this system. The folder and inverter are in the same modular pullout unit in this "1055" copier, and share some components and paper paths. However, as understood from this "1055" descriptive material, a solenoid actuated folder stop finger inserted at or past the downstream end of the inverter or sheet reversing chute stops the lead edge of a large size 11×17 sheet fed therein before the trail end of that same large sheet clears the entrance rollers. This causes the sheet to buckle in the center of the sheet, and that buckled paper is forced between the lower entrance roll and an inverter roll, at the upstream, entrance, end of the inverter chute. The pressure between those two rollers causes the fold in the paper. The folded paper then feeds around the inverter roll and on to the exit area.

The subject dual mode inverter and sheet folding system is fully integrated, and shares and commonly utilizes space and components in common with both modes of its operation. The disclosed system also enhances the capabilities of some of the above-described and other traditional sheet buckle folders by automatically providing for an adjustable fold position almost anywhere along a sheet, for various sizes of sheets.

A feature of the specific embodiment disclosed herein is to provide an integral dual mode sheet inverting and folding system, wherein printed sheets are selectable inverted without folding in a first mode, or folded in a second mode; including: a sheet inverting chute for receiving and guiding sheets in both said first and second modes, said chute having first and second sides and an input; a sheet feeding input system for feeding sheets into said chute in both said first and second modes; a sheet folding aperture extending through both said first and second sides of said chute; a sheet folding nip roller system mounted at said first side of said chute adjacent to said sheet folding aperture; a sheet folding blade mounted at said second side of said chute adjacent to said sheet folding aperture for movement through said sheet folding aperture towards said sheet folding nip roller system only in said first mode; and a sheet positioning system for positioning a sheet in said chute relative to said sheet folding aperture in said chute in said first mode.

Further features disclosed herein, individually or in combination, include those wherein said sheet positioning system is a reversible sheet feeding system in said chute which, in said second mode, reverse feeds unfolded sheets in said sheet inverting chute back out of said chute input; and/or wherein said sheet positioning system is a reversible sheet feeding system in said chute which, in said first mode, reverse feeds a sheet in said chute through said sheet folding aperture towards said sheet folding nip roller system; and/or wherein said sheet positioning system comprises a servo motor driven reversible sheets, and folding a sheet driven out of said intermediate aperture in said chute by feeding said sheet from said intermediate aperture into a sheet folding nip; and/or further including moving a folding blade member through said intermediate aperture in said chute from said first side to said second side of said chute to buckle and push the portion of a sheet in said chute adjacent to said intermediate aperture out of said second side of said chute and into said sheet folding nip.

In reproduction apparatus such as xerographic and other copiers and printers or multifunction machines, it is increasingly important to provide faster yet more reliable and more automatic handling of the physical image bearing sheets. It is also desirable in many cases to offer to provide automatic on-line sheet finishing of printed sheets, such as for booklet-making, making book squires of plural 4-up sheets for center binding, flush or Z-folding large insert sheets for smaller size booklets or document sets, and various other well know reasons. It is desirable to reliably feed and accurately register copy sheets of a variety and/or mixture of sizes, types, weights, materials, humidity and other conditions. In particular, it is desirable to minimize sheet misfeeding, skewing, jamming, or damage. Sheets can vary considerably even if they are all of the same "standard" size, (e.g. letter size, legal size, A-4, B-4, etc.). They may have come from different paper batches or have variably changed size with different age or humidity conditions, different imaging, fusing, etc. Sheet skewing, misregistration or misfeeding can also adversely affect further feeding, ejection, and/or stacking and finishing.

The disclosed system may be operated and controlled by appropriate operation of conventional control systems. It is well known and preferable to program and execute printing, paper handling, and other control functions and logic with software instructions for conventional or general-purpose microprocessors, as taught by numerous prior patents and commercial products. Such programming or software may of course vary depending on the particular functions, software type, and microprocessor or other computer system utilized, sheet feeding roller engaging a sheet in said inverting chute, to provide a selectively variable folding position by providing a selectively variable position of a sheet in said inverting chute relative to said sheet folding aperture in said chute; and/or wherein said sheet positioning system comprises a servo motor driven reversible sheet feeding roller for engaging a sheet in said inverting chute, said sheet feeding roller being mounted downstream of said sheet folding aperture in said chute; and/or a dual mode integral apparatus for selected inverting of sheets or folding of sheets, said dual mode apparatus including a sheet inverting chute for receiving and guiding a sheet therein, said chute having first and second sides, an input, and an intermediate aperture; a sheet feeding input system for feeding a sheet into said chute; and a sheet reversing system for reversing the movement of a sheet in said chute; said dual mode apparatus further comprising; means for reverse driving a sheet in said chute back to said chute input with said sheet reversing system for said selected inverting of sheets; means for reverse driving a sheet in said chute out of said intermediate aperture in said chute with said sheet reversing system for said folding of sheets, and means for folding a sheet driven out of said intermediate aperture in said chute; and/or further including a folding blade and means for moving said folder blade through said intermediate aperture in said chute from said first side to said second side of said chute to push a portion of a sheet in said chute adjacent to said intermediate aperture out of said second side of said chute and into said means for folding a sheet; and/or a method of selectable inverting of sheets or folding of sheets with a dual mode apparatus, said dual mode apparatus including a sheet inverting chute for receiving and guiding a sheet therein, said chute having first and second sides, an input, and an intermediate aperture; a sheet feeding input system for feeding a sheets into said chute; and a sheet reversing system for reversing the movement of a sheet in said chute, comprising; reverse driving a sheet in said chute back to said chute input for said inverting of sheets; buckling and reverse driving a sheet in said chute out of said intermediate aperture in said chute for said folding of but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs, such as selecting a copy sheet supply tray, etc. The resultant controller signals may conventionally actuate various conventional electrical servo or solenoid motors, clutches, or other components, the in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders, etc., as is well known in the art.

In the description herein the term "sheet" refers to a usually flimsy physical sheet of paper, plastic, card stock, or other suitable physical substrate for images, whether precut or initially web fed and then cut. A "copy sheet" may be abbreviated as a "copy", or called a "hardcopy". The terms "servo", "servomotor", etc., will be understood to encompass equivalent steppers, stepper motors, etc.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be re-described here.

Various of the above-mentioned and further features and advantages will be apparent from the specific apparatus and its operation described in the example below, and the claims. Thus, the present invention will be better understood from this description of one specific embodiment, including the drawing figures (approximately to scale) wherein:

FIG. 1 is a schematic frontal view of on example of an integral dual mode sheet inverting and sheet folding system in accordance with the invention incorporated into one example of an existing plural sheet output path from a reproduction apparatus with an existing inverter.

Describing now in further detail the exemplary embodiment with reference to FIG. 1, this disclosed dual mode sheet folding and inverting system 50 can fold sheets of various sizes, in various desired folding positions. It will be appreciated that this folding system may be incorporated into, or modularly connected to, the output of various reproduction machines, not limited to this FIG. 1 example, and can provide rapid automatic on-line folding of various printed sheets for various purposes. For example, the folded sheet path here may also provide for inversion, or not, of the folded sheets output, as by adding a natural inversion path, or not, to that sheet path.

It will also be appreciated by those skilled in the art that although single sheet folding is illustrated here, that well known or conventional sheet set compilers (stackers) could be provided upstream of the subject folder systems to accumulate the desired or suitable number of superposed sheets and to feed those plural superposed sheets into the system for common folding in essentially the same manner as is illustrated for single sheets.

Typical prior art sheet folding systems have registration or sheet lead edge stops inserted into the fold plate or chute so that further in-feeding of the stopped sheet, and/or insertion of a fold blade into the sheet pushing it towards a fold rolls nip, causes the sheet to buckle towards the fold rolls nip, which then pulls the sheet into and through that sheet folding nip.

Turning now to the dual mode embodiment 50 of FIG. 1, as illustrated, a number of advantageous features are provided. Much of the componentry, controls and space can be that of an existing sheet inverter system 51, and shared with that sheet inverter. Furthermore, the capabilities of a traditional sheet buckle folder are enhanced here by allowing the folding position to be selected almost anywhere desired along the sheet, not just even-folding (half-folding), and being able to do so for various sheet sizes, even rapid sequences of different intermixed sheet sizes.

The sheet folding system embodiment 50 being integral with and incorporated into a known type of sheet inverter system 51 is especially desirable for space savings in an overall reproduction and finishing system. It allows optional sheet folding to be provided inside of existing reproduction machines or output modules therefor, in existing space. Many printers or copiers, or interposers or finishers therefor, already have an existing internal output inverter. Thus, the addition of a large extra attached module to provide folding, such as a third party sheet folder module, requiring additional floor space, can be avoided.

This folding or inverting system 51 is shown in this example as part of a three-path (three parallel output paths) system for the printed sheets being inputted (at the left side here) from a reproduction apparatus, as selected and controlled by a controller 101. All three selectable paths merge into a common output path, as shown at the right side of FIG. 1.

The position of input gate 52 determines whether the sheets go through the upper path directly to the output, bypassing the inverting or folding operation, or into the second path into the folding or inverting system 51 via inverter drive roller 53 and its mating idler roll 54. The latter selected sheet is fed into the inverter chute 55 to the nip of a servomotor "M" driven reversible roll 56. Sheet size information, sheet timing and/or location, plus the desired processing mode for the sheet (inversion or not, folding or not, and where to fold) is available from the upstream reproduction apparatus and/or network and/or sheet path sensors such as S1 and S2, and programming in controller 101. The sheet position can also be tracked by the usual optical or other rotary movement encoder on the servomotor M here.

If the sheet inversion mode is selected, servomotor M reverses roller 56 to feed the sheet back up the inverter chute 55 past a passive gate 57 into the inverter output nip defined by drive roller 53 and output idler 58, and on to the sheet output via the rest of the first sheet path. (The rollers 53, 54, 58 with 10 their two nips form a conventional "tri-roll inverter" configuration.)

The system 50 allows most of these same components and space used for sheet inversion in the unit 51 to alternatively be used for sheet folding. Furthermore, it can fold any normal size printed sheet in almost any desired fold position along that sheet.

If sheet folding was selected for an incoming sheet instead of inversion without folding, gate 52 similarly initially deflects that sheet into the inverter chute 55, and the sheet is similarly engaged and fed further into the chute 55 by the roller 56 in the chute 55 running in its forward direction. However, drive roller 56, which is downstream of chute opening 60, is stopped by servo motor M once the sheet has fed into the chute 55 such that the desired fold point of the sheet is now located in line with the fold path opening 60 in the chute 55. The inverter entrance idler 54 is moved by a solenoid 61 to open that nip, to free any trailing portion of the sheet that may be in that input nip. Meanwhile, a solenoid or motor 62 starts to drive a folder blade or knife 63 from one side of the chute 55 through the opening 60 and then pushes the sheet into a folding nip 64 on the other side of chute 55 defined by a folding roller 65 and its mating idler to fold the sheet in that fold position and feed the folded sheet on past a sensor S3 and through the third (lower) sheet path here (for the folded sheets) to the common output. In coordination therewith, the roller 56 has been reversed and is run at the same velocity as the folding nip 64 to help feed the leading portion of the sheet into the folding nip 64. The chute baffle 55 at the opening 60 is desirably smoothly arcuately transitioning towards the folding nip 64, as shown.

To further describe this sheet folding mode operation, in other words, assume, as an example, that center folding of a sheet is desired. The servo motor M driven roller 56 would stop when that particular size sheet has been fed far enough in the inverter chute 55 for the center of that particular sheet to be positioned in line with the folder blade 63 and opening 60. The folder blade 63 then moves towards the chute 55 sheet path at 90 degrees thereto, towards opening 60 and the area of the sheet exposed in that opening, to initiate the sheet folding. The folder blade 63 continues that movement to buckle and push the center of the sheet out of the other side of the opening 60 into the fold nip 64, which feeds the folded sheet on in a separate path at approximately 90 degrees to the original sheet path of the inverter chute 55, assisted by the reversal of roller 56 and release of the inverter input nip as described above.

The blade 63 retracts back out of the chute 55 opening 60 after the sheet to be folded is acquired in the fold nip 64. Thus, the chute 55 is free for another (the next) sheet to start to be fed therein. In addition, solenoid 61 is disengaged, allowing the inverter entrance idler 54 to drop and servo motor M drives roller 56 in the forward direction in order to accept the next sheet to be processed.

While the embodiments disclosed herein is are preferred, it will be appreciated from this teaching that various alternatives, modifications, variations or improvements therein may be made by those skilled in the art, which are intended to be encompassed by the following claims.

What is claimed is:

1. An integral dual mode sheet inverting and folding system, wherein printed sheets are selectably inverted without folding in a first mode, or folded in a second mode; including:

a sheet inverting chute for receiving and guiding sheets in both said first and second modes, said chute having first and second sides and an input, a sheet feeding input system for feeding sheets into said chute in both said first and second modes, a sheet folding aperture extending through both said first and second sides of said chute, a sheet folding nip roller system mounted at said first side of said chute adjacent to said sheet folding aperture, a sheet folding blade mounted at said second side of said chute adjacent to said sheet folding aperture for movement through said sheet folding aperture towards said sheet folding nip roller system only in said first mode, and a sheet positioning system for positioning a sheet in said chute relative to said sheet folding aperture in said chute in said first mode.

2. The integral dual mode sheet inverting and folding system of claim 1 wherein said sheet positioning system is a reversible sheet feeding system in said chute which, in said second mode, reverse feeds unfolded sheets in said sheet inverting chute back out of said chute input.

3. The integral dual mode sheet inverting and folding system of claim 1 wherein said sheet positioning system is a reversible sheet feeding system in said chute which, in said first mode, reverse feeds a sheet in said chute through said sheet folding aperture towards said sheet folding nip roller system.

4. The integral dual mode sheet inverting and folding system of claim 1 wherein said sheet positioning system comprises a servo motor driven reversible sheet feeding roller engaging a sheet in said inverting chute, to provide a selectively variable folding position by providing a selectively variable position of a sheet in said inverting chute relative to said sheet folding aperture in said chute.

5. The integral dual mode sheet inverting and folding system of claim 1 wherein said sheet positioning system comprises a servo motor driven reversible sheet feeding roller for engaging a sheet in said inverting chute, said sheet feeding roller being mounted downstream of said sheet folding aperture in said chute.

* * * * *